US009248996B2

(12) United States Patent
Wüest et al.

(10) Patent No.: US 9,248,996 B2
(45) Date of Patent: Feb. 2, 2016

(54) DEVICE FOR VENTILATING AN ELEVATOR CAGE

(75) Inventors: Thomas Wüest, Hochdorf (CH); René Strebel, Buttwil (CH); Lukas Zeder, Huddinge (SE); Urs Schaffhauser, Root (CH); Christoph Schuler, Cham (CH); Beat Brügger, Lucerne (CH)

(73) Assignee: Inventio AG, Hergiswil (CH)

( * ) Notice: Subject to any disclaimer, the term of this patent is extended or adjusted under 35 U.S.C. 154(b) by 617 days.

(21) Appl. No.: 13/334,824

(22) Filed: Dec. 22, 2011

(65) Prior Publication Data

US 2012/0164928 A1 Jun. 28, 2012

(30) Foreign Application Priority Data

Dec. 22, 2010 (EP) ..... 10196612

(51) Int. Cl.
*F24F 7/00* (2006.01)
*B66B 11/02* (2006.01)

(52) U.S. Cl.
CPC ..... *B66B 11/024* (2013.01)

(58) Field of Classification Search
CPC ..... B66B 11/024; F24F 7/007; F24F 11/0001
USPC ..... 454/68
See application file for complete search history.

(56) References Cited

U.S. PATENT DOCUMENTS 2,398,627 A * 4/1946 Disbro et al. ..... 454/68
4,287,962 A * 9/1981 Ingard et al. ..... 181/224
5,080,003 A * 1/1992 Kappeler ..... 454/68
5,306,208 A * 4/1994 Sommerrock et al. ..... 454/68
5,460,570 A * 10/1995 Okamura et al. ..... 454/68
5,593,347 A * 1/1997 Mandy et al. ..... 454/68
6,488,126 B1 * 12/2002 Yamakawa et al. ..... 187/391
7,549,505 B1 * 6/2009 Kawar ..... 181/210
7,833,310 B2 * 11/2010 Kwon et al. ..... 95/3
8,336,672 B2 * 12/2012 Derks et al. ..... 181/224
8,500,525 B2 * 8/2013 Opoku et al. ..... 454/68
2005/0161280 A1 * 7/2005 Furuya ..... 181/225

(Continued)

FOREIGN PATENT DOCUMENTS

EP 0418511 A1 3/1991
JP 56072886 U 6/1981

(Continued)

OTHER PUBLICATIONS

British Standard Safety Rules, Sep. 1999.*

*Primary Examiner* — Steven B McAllister
*Assistant Examiner* — Jonathan Cotov
(74) *Attorney, Agent, or Firm* — Fraser Clemens Martin & Miller LLC; William J. Clemens

(57) ABSTRACT

An elevator cage is movable in an elevator shaft, wherein a ventilating device is fastened to a cage outer surface, wherein this ventilating device forms at least one ventilation channel, wherein the at least one ventilation channel has at least one primary ventilation opening enabling an air exchange between the ventilation channel and the elevator shaft, wherein at least one of the cage outer surfaces has at least one secondary ventilation opening enabling an air exchange between a cage interior space and the at least one ventilation channel, with at least one element of insulating material, and wherein the at least one element substantially determines a path of the at least one ventilation channel.

17 Claims, 4 Drawing Sheets

(56) References Cited

U.S. PATENT DOCUMENTS

| | | | | |
|---|---|---|---|---|
| 2008/0190711 | A1* | 8/2008 | Patrick et al. | 187/401 |
| 2009/0011696 | A1* | 1/2009 | Matthews | 454/254 |
| 2010/0147626 | A1* | 6/2010 | Jebing | 182/141 |

FOREIGN PATENT DOCUMENTS

| | | | |
|---|---|---|---|
| WO | 2006011885 | A2 | 2/2006 |
| WO | WO 2006011914 | A2 * | 2/2006 |
| WO | 2010026626 | A1 | 3/2010 |

* cited by examiner

DEVICE FOR VENTILATING AN ELEVATOR CAGE

CROSS-REFERENCE TO RELATED APPLICATION

This application claims priority to European Patent Application No. 10196612.5, filed Dec. 22, 2010, which is incorporated herein by reference.

FIELD

This disclosure relates to devices for ventilating elevator cages.

BACKGROUND

Known exemplifying elevator installations include an elevator cage, a counterweight and a support means which connects the elevator cage and the counterweight together by way of a drive. The elevator cage is moved in an elevator shaft by this drive.

EP 0418511 describes a device for ventilating elevator cages, wherein a vertical air flow arises in an elevator cage, the air flow being produced by travel wind and backpressure at the air-displacing elevator cage. A ventilation channel in an upper region of the elevator cage consists of primary air openings, chambers, air channels and secondary air openings. The chambers and air channels are formed by claddings and wind guide plates. The wind guide plates smooth the air flow. The wind guide plates and the claddings are provided with a material for noise insulation.

A possible problem with such a solution is costly equipping of the ventilation channel with the material for noise insulation.

SUMMARY

At least some embodiments of the disclosed technologies comprise a ventilating device which produces a ventilation channel with simultaneously effective sound insulation in the cage interior space.

Further embodiments comprise an elevator cage which is movable in an elevator shaft, wherein a ventilating device is fastened to a cage outer surface, wherein this ventilating device forms at least one ventilation channel, wherein the at least one ventilation channel has at least one primary ventilation opening enabling air exchange between the ventilation channel and the elevator shaft, wherein at least one of the cage outer surfaces has at least one secondary ventilation opening enabling air exchange between a cage interior space and the at least one ventilation channel, with at least one element of insulating material, wherein the at least one element substantially determines a path of the at least one ventilation channel.

At least some embodiments are based on a simplified construction of the ventilating device that simplifies production and minimizes costs. A combination of a shaping of the ventilating channel with a cladding of this ventilation channel by means of insulating material saves installation and production outlay.

In addition, at least one of the ventilation channels is formed to be rectilinear. This can allow for simple production, since the ventilation channels can be introduced in simple manner into the material of the element. In an alternative form of embodiment the ventilation channels are produced by bores.

In a further embodiment at least one of the ventilation channels has curves. This can allow for enhanced noise insulation during operation of the ventilating device.

In additional embodiments at least one ventilation channel is formed by a single element, wherein one or more substantially rectilinear ventilation channels are formed by a cut-out in this element. This can allow for simple installation of the ventilating device, since mounting of the ventilating device is limited to only this element. This can also mean that only one material is processed during production of the ventilating device.

In additional embodiments a support is arranged in the at least one ventilation channel. This can allow for increased stability of the ventilation channel.

In further embodiments the ventilating device consists of two elements, wherein the two elements determine a path of the at least one ventilation channel. This can allow for a design freedom of the ventilation channels at the time of mounting the ventilating device. It can also allow for selection of one of the two elements, which increases stability of the ventilating device.

In some embodiments, at least one element of the ventilating device has porous regions, wherein the air flows through these porous regions and wherein these porous regions at least partly form the at least one ventilation channel. This can allow simple construction of the ventilating device and a stable design of the ventilation channel. Further features are the possibility of a filtering effect of this porous region and also smoothing of the air flow in the ventilation channel. This smoothing of the air flow leads to a minimized sound loading by the ventilating device.

In further embodiments, at least one of the elements of the ventilating device is adhesively fixed to one of the cage outer surfaces. This can allow for mounting of the ventilating device at the cage outer wall in both a simple and time-saving manner, since no further bores or fastening elements are needed for fixing of the element to the elevator cage.

In additional embodiments, one of the ventilating devices is arranged on the cage roof and is part of a foot strip. A combination of the foot strip with the ventilating device can save installation outlay and costs.

In some embodiments, at least one of the ventilating devices is arranged at the cage wall. This can result in saving of space on the cage roof or on the cage floor.

In further embodiments, the ventilating device comprises a cable guide. This can result in protection of the cable, which is guided therein, by the ventilating device.

In additional embodiments, ventilating channels are arranged at one of the cage outer surfaces, wherein at least one secondary ventilating opening is arranged in this cage outer surface, wherein the at least one secondary ventilating opening enables air exchange between the ventilating channels and the cage interior space, wherein the ventilating channel has a primary ventilating opening, wherein the at least one primary ventilating opening enables air exchange between the ventilating channel and the elevator shaft, wherein a fan is so arranged at this primary ventilating opening that an air flow through the ventilating channel can be produced substantially only by operation of the fan, and wherein an air exchange between the at least one ventilation channel and the ventilating channel can take place only through the cage interior space and/or the elevator shaft.

This can result in a device that is designed with minimum requirements and powers, since ventilation by the ventilating channels exclusively can have an enhancing effect with respect to ventilation of the cage interior space. It can also mean that only a fan of small constructional form is needed and can be positioned in space-saving manner. The device can thus be additionally protected from damage.

In some cases the fan can be switched off. The result is that the fan only has to be operated when needed. This is possible, for example, after a longer period of standstill.

In further cases the fan is a computer fan. A generally known computer fan can give rise to minimum costs not only in acquisition, but also in operation.

BRIEF DESCRIPTION OF THE DRAWINGS

The disclosed technologies are explained in more detail in the following by way of the figures, in which.

DETAILED DESCRIPTION

Figure 1:
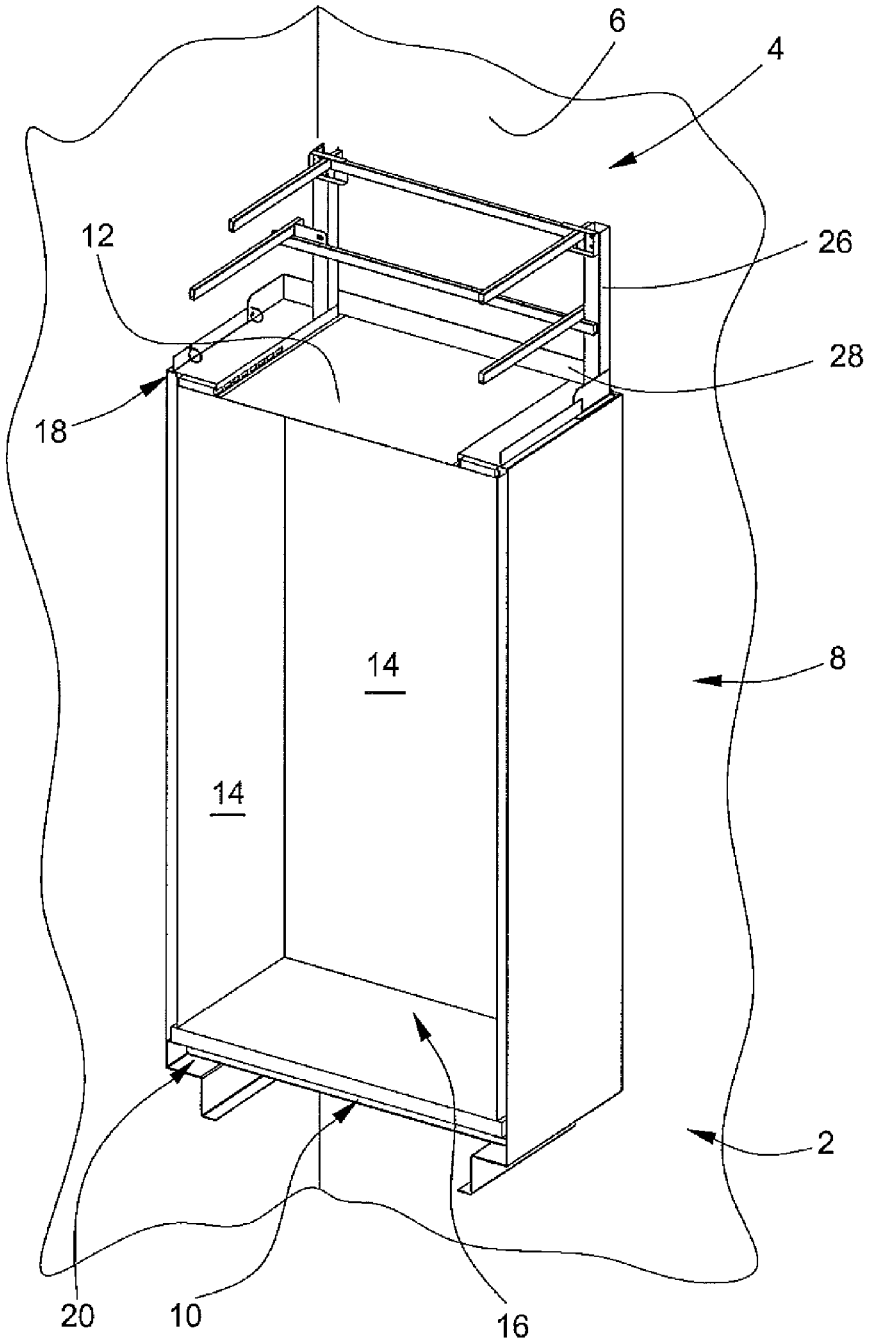
FIG. 1 shows a perspective sectional illustration of an elevator cage in an elevator shaft with a ventilating system.

FIG. 1 shows a perspective sectional illustration of an elevator installation 2 in an elevator shaft 4. The elevator shaft 4 is, for example, bounded at all sides by a shaft wall 6. The elevator installation 2 comprises an elevator cage 8 having cage outer surfaces 10, 12, 14. These cage outer surfaces 10, 12, 14 are a cage roof 12, cage walls 14 and a cage floor 10. The cage roof 12, the cage walls 14 and the cage floor 10 delimit a cage interior space 16 from the elevator shaft 4. Further components of the elevator installation 2 such as, for example, drive, support means, counterweight or doors are not illustrated.

In the selected exemplifying embodiment the cage walls 14 are elevated above a plane of the cage roof 12 in the form of a balustrade 26. Part of this balustrade 26 is a foot strip 28 at the cage roof 12.

A ventilating system consists of an upper ventilating device 18 and a lower ventilating device 20. The upper ventilating device 18 is arranged as a part of the foot strip 28 on the cage roof 12. The lower ventilating device 20 is disposed at the cage floor 10.

Through displacement of the air during cage travel a backpressure arises in front of the elevator cage 8 in travel direction. This backpressure produces an air flow through the upper and lower ventilating devices 18, 20 and the interior cage space 16. The ventilating devices 18, 20 can also be positioned at the cage walls 14 independently of one another.

Figure 2:
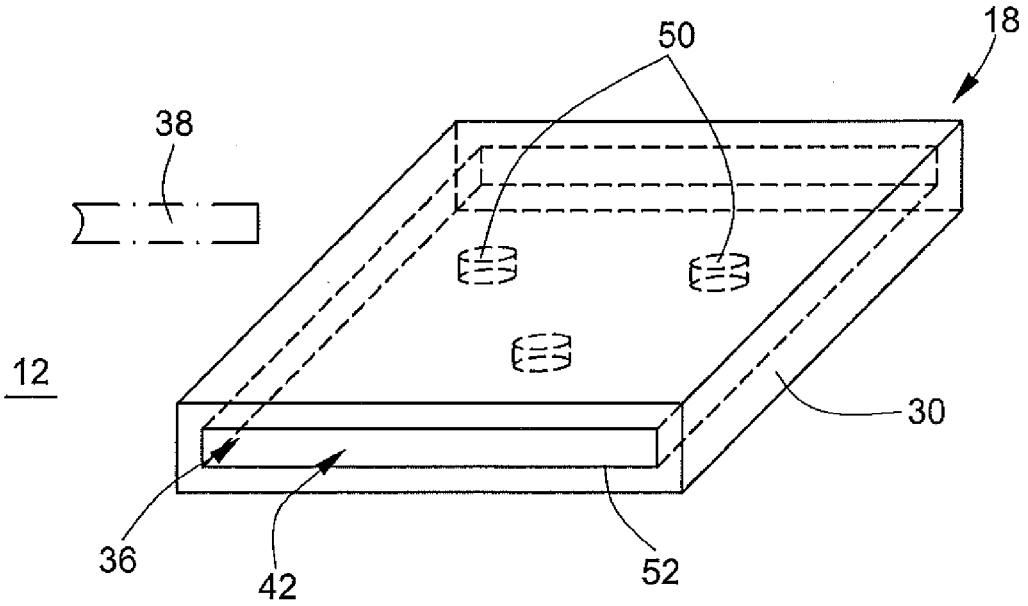
FIG. 2 shows a perspective illustration of an upper ventilating device with a first variant for forming a ventilation channel.

FIG. 2 shows an exemplary embodiment of an upper ventilating device 18 which is fastened on the cage roof 12. The cage roof 12 has secondary ventilation openings 38. The upper ventilating device 18 consists of a single element 30. This element 30 has a cut-out 52. This cut-out 52 forms the ventilation channel 42. The primary ventilation opening 36 of the upper ventilating device 18 is indicated. Supports 50 are introduced into the ventilation channel 42 for stabilizing the cut-out 52. However, the supports 50 can also be a component of the element 30 and be removed from the cut-outs 52. The ventilation channel 42 is substantially rectilinear. As an alternative to the variant, which is shown in FIG. 2, of the upper ventilating device 18 several ventilation channels 42 can be formed in the element 30 so as to be able to dispense with the supports 50.

The upper ventilating device 18 is so arranged in the cage roof 12 that an air exchange between the ventilation channel 42 and the cage interior space 16 via the secondary ventilation opening 38 takes place. An air exchange between the elevator shaft 4 and the ventilation channel 42 takes place via the primary ventilation openings 36. The cage roof 12 and the element 30 are so formed at the common contact surface thereof that the air flow through the ventilation channel 42 of the secondary ventilation opening 38 does not cause any unnecessary noises. The element 30 can consist of any insulating material in order to minimize arising noises caused by, for example, air flows or elevator travels. The insulating material can be, for example, a porous solid body or a foam material.

Figure 3:
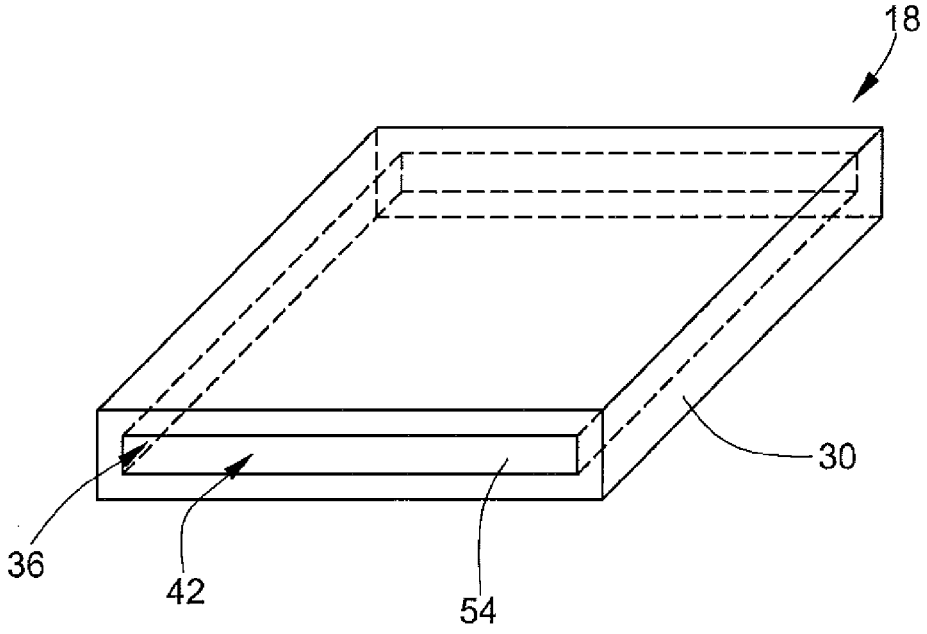
FIG. 3 shows a perspective illustration of an upper ventilating device with a second variant for forming the ventilation channel.

FIG. 3 shows a further variant for forming the upper ventilating device 18. The upper ventilating device 18 consists of a single element 30 with a primary ventilation opening 36. The ventilation channel 42 is formed by a porous region 54 of the element 30. The porous region 54 extends in the entire ventilation channel 42. Alternatively, the porous region 54 can also form only a part of this ventilation channel 42. A remaining region of the ventilation channel 42 can, for example, be realized by a cut-out 52.

The porous region 54 can, for example, take over the function of an additional noise insulation or of a filter in order to avoid contaminations in the cage interior space 16. Counting amongst these contaminations are, for example, insects, dust, liquids and also disagreeable odors.

Figure 4:
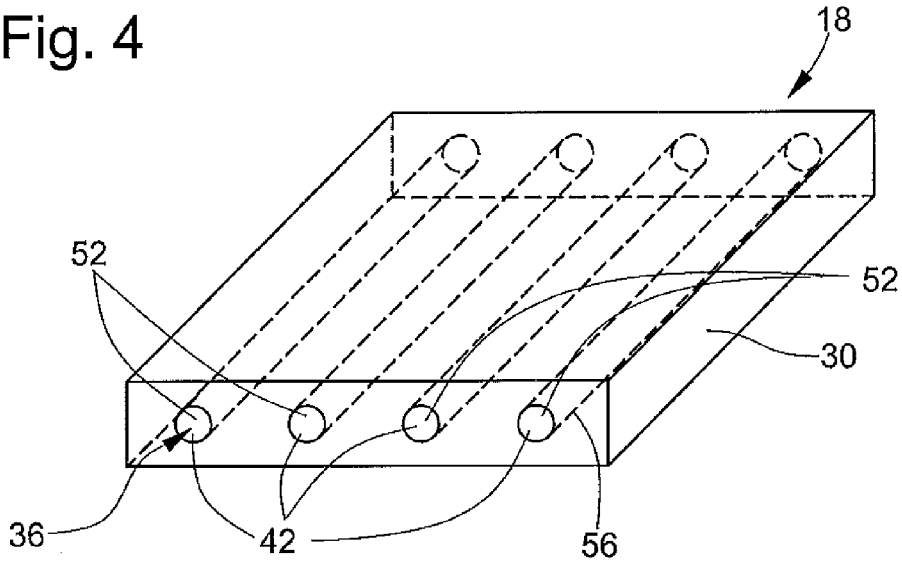
FIG. 4 shows a perspective illustration of an upper ventilating device with a third variant for forming ventilation channels.

FIG. 4 shows a further form of embodiment of the upper ventilating device 18. The upper ventilating device 18 consists of an element 30. Cut-outs 52 with primary ventilation openings 36 run rectilinearly through this element 30. These cut-outs 52 are produced by bores 56. These ventilation channels 42 created by drilling can allow for favorable production. Alternatively thereto at least one of these ventilation channels 42 can have curvatures of any geometry in order to realize an enhanced noise damping.

Figure 5:
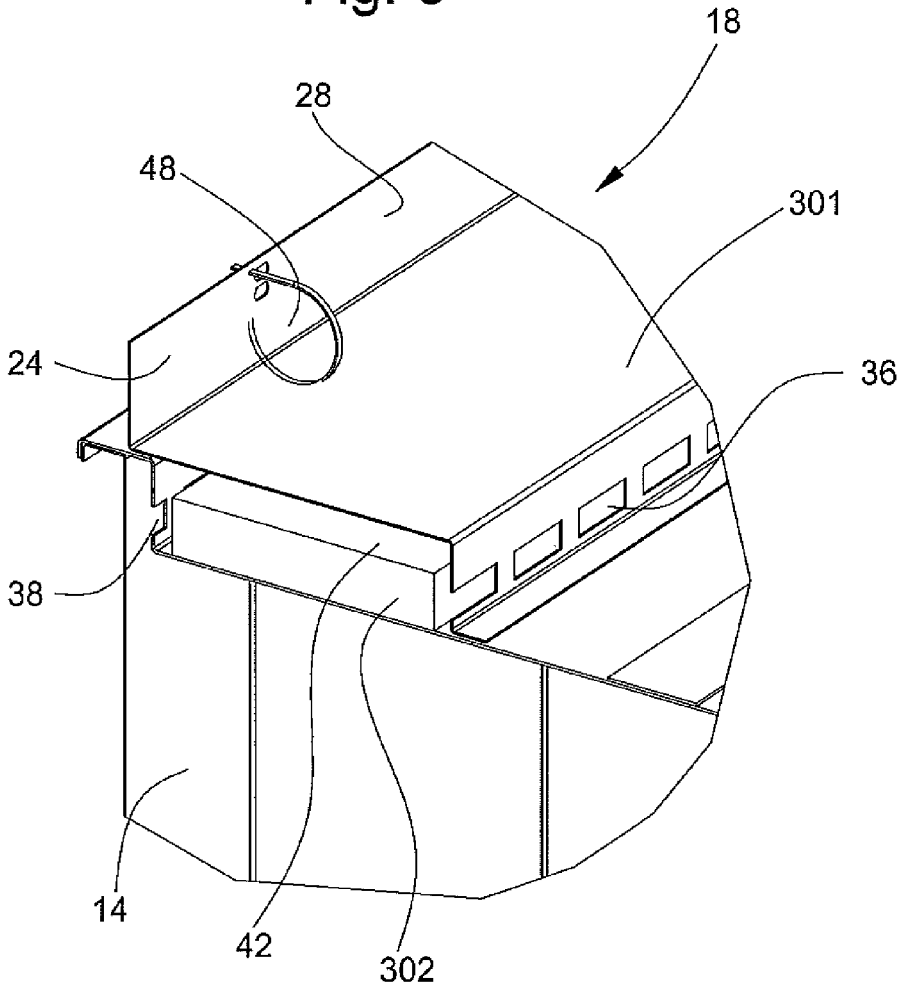
FIG. 5 shows a perspective sectional illustration of an upper ventilating device on a cage roof.

In departure from the illustration, the upper ventilating device 18 of FIGS. 2, 3, 4 can also consist of several elements 301, 302, wherein one of these elements 302 is of a material for noise insulation. FIG. 5 shows a perspective sectional illustration of the upper ventilating device 18 on the cage roof 12. The upper ventilating device 18 is provided with a flange 24 as part of a foot strip 28. This flange 24 elevates a cage wall 14 above a plane of the upper ventilating device 18. A cable guide 48 is disposed at the flange 24. The upper ventilating device 18 consists of a plurality of elements. These elements are a cover element 301 and an insulating body 302, which are adhesively fastened on the cage roof 12. A ventilation channel 42 is formed between the cover element 301 and the insulating body 302. The cover element 301 and the insulating body 302 substantially determine a path of the ventilation channel 42. The cover element 301 has primary ventilation openings 36. Secondary ventilation openings 38 are disposed in the cage roof 12.

The fastening of cover element 301 and insulating body 302 by adhesion to the cage roof 12 is by way of example and can alternatively also be realized by means of known fastening devices such as, for example, screw or rivet connections.

The primary ventilation openings and the secondary ventilation openings 36, 38 are arranged at the same height in FIGS. 2 to 5. Thus, the air flow is guided substantially horizontally through the upper ventilating device 18. A direct, rectilinear, perpendicular connection between the elevator shaft 4 and the interior cage space 12 is thus avoided. Such a rectilinear, perpendicular connection could generate perceptible and disturbing noises in the cage interior space 12. An arrangement of the primary ventilation openings 36 and the secondary ventilation openings 38 at different heights is possible.

The characteristics, which are described in more detail in FIGS. 2 to 5, of an upper ventilating device 18 can also be transferred to a lower ventilating device 20 in the region of a cage floor 10. The ventilating devices 18, 20 can be arranged at all cage outer surfaces 10, 12, 14.

The specification EN 81-1:1998+A3:2009 requires a balustrade and a foot strip to be present if, for example, a horizontal distance of 0.3 meters from a cage roof to a shaft wall is exceeded. The minimum height of this balustrade is dependent on this horizontal distance. The foot strip 28 has a required height of at least 0.1 meters above a plane of the cage roof 12. It is possible to install the upper ventilating system 18 as part of this foot strip 28. Subject to the precondition that the upper ventilating device 18 is not to be walked on, the height of the upper ventilating device 18 above the plane of the cage roof 12 can be taken into consideration as part of the required height of the foot strip 28. In order to complete the required height of the foot strip 28 the upper ventilating device 18 is provided with the flange 24. The height of the upper ventilating device 18 above the cage roof 12 added to a vertical height of the flange 24 corresponds with the required height of the foot strip 28.

Figure 6:
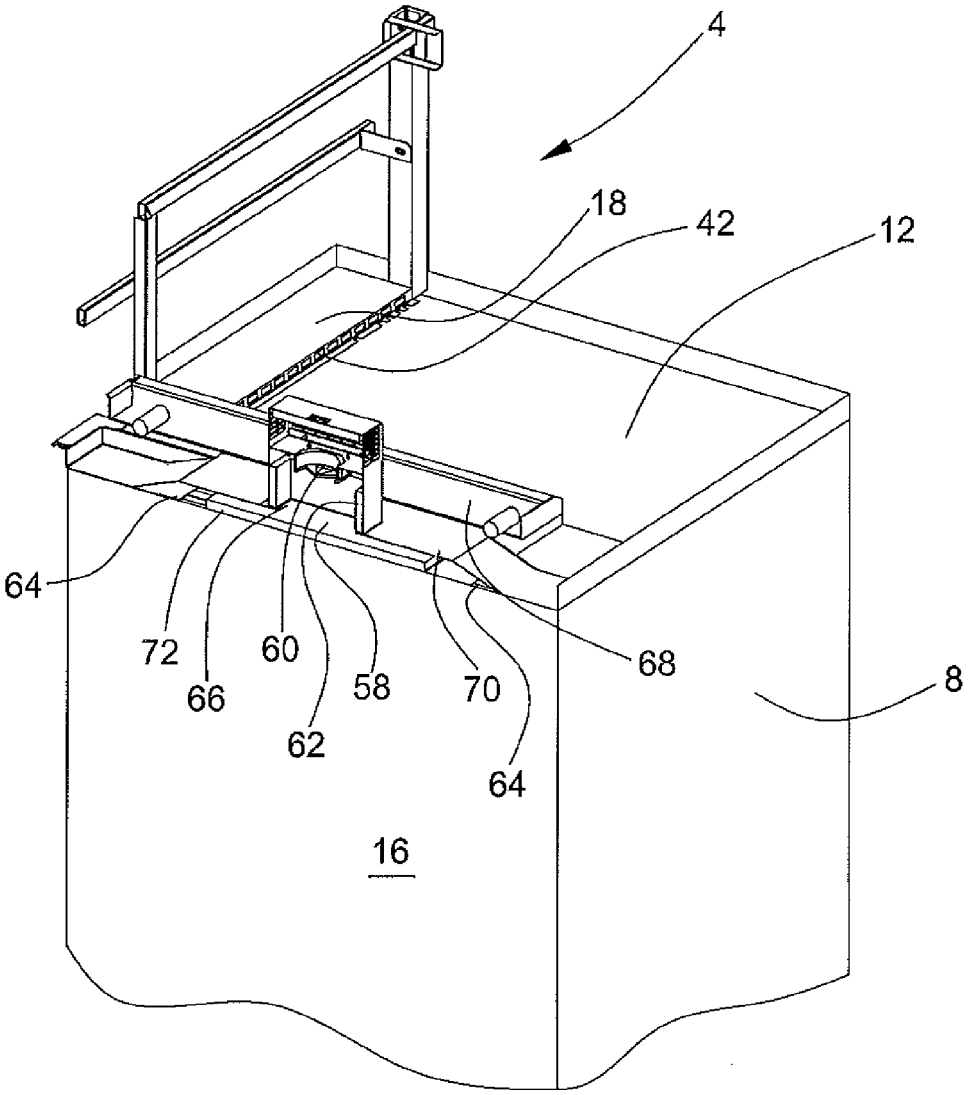
FIG. 6 shows a perspective sectional illustration of additional ventilating channels with a fan.

FIG. 6 shows a perspective sectional illustration of ventilating channels with a fan which can be arranged additionally to an existing ventilating device 18 at the elevator cage 8. Ventilating channels 58 are arranged on the cage roof 12 at a cage frame 68. The ventilating channels 58 are bounded by the cage roof 12 and by a cover plate 70. An insulating element 72 is positioned in the ventilating channels 58 on the cage roof 12. The cage roof 12 has secondary ventilating openings 64 enabling an air exchange between the cage interior space 16 and the ventilating channels 58. The ventilating channels 58 have a primary ventilating opening 66 enabling an air exchange between the elevator shaft 4 and the ventilating shaft 58. A fan receptacle 62 is arranged at the primary ventilating opening 66. The fan receptacle 62 comprises a fan 60 so that an air flow through the ventilating channels 58 can be produced substantially only by the operation of the fan 60. The ventilation channels 42 of the upper ventilating device 18 and the ventilating channels 58 are separate from one another, i.e. an air exchange between the ventilation channels 42 and the ventilating channels 58 can take place only via the cage interior space 16 or via the elevator shaft 4. Thus, in addition to the ventilating system 18, 20 described in FIGS. 1 to 5, which is based on passive ventilation, the cage interior space 16 can be ventilated by operation of the fan 60. A fan 60 with low power can be selected, because the ventilation by the ventilating channels 58 has a supplementary effect to the ventilation of the ventilating system 18, 20. Accordingly, the ventilating channels 58 can be constructed to be small and arranged in space-saving manner on the cage outer surfaces 10, 12, 14. The fan 60 can be, for example, a commercially available computer fan. The ventilating channels 58 and/or the ventilating devices 18, 20 can be so constructed that they are not connected with the cage frame 68, so as to avoid solid-body sound bridges.

At least some embodiments of the upper ventilating device 18 provide a simple and thus favorable mode of construction. A combination of foot strip 28 and the upper ventilating device 18 can be advantageous during production and mounting of the elevator cage 8. Some embodiments allow for factory preassembly of the ventilating devices 18, 20 on cage outer surfaces 10, 12, 14. The ventilating system 18, 20 is possibly constructed as passive ventilation and thus favorable in operation. The foot strip 28 has a protective effect on the cable guide 48.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. An elevator cage, comprising:

a plurality of outer surfaces delimiting a cage interior space;

a ventilating device fastened to a one of the outer surfaces, the ventilating device including at least one ventilation channel for exchange of air between the cage interior space and an exterior of the elevator cage, the at least one ventilation channel having at least one primary ventilation opening open to the elevator cage exterior, the one outer surface having at least one secondary ventilation opening between the cage interior space and the at least one ventilation channel; and an insulating element included in the ventilating device and being formed of an insulating material, the insulating element forming a horizontally extending surface of the at least one ventilation channel, the at least one primary ventilation opening and the at least one secondary ventilation opening being positioned at a same height relative to the one outer surface to guide air flow substantially horizontally through the at least one ventilation channel of the ventilating device, wherein the one outer surface is a cage roof and the ventilating device forms a part of a foot strip on the cage roof leaving a portion of the cage roof exposed.

2. The elevator cage according to claim 1 wherein an entirety of the at least one ventilation channel is formed in the insulating element.

3. The elevator cage according to claim 2 wherein the at least one ventilation channel has a rectilinear form.

4. The elevator cage according to claim 2 wherein the at least one ventilation channel is formed by a cut-out in the insulating element.

5. The elevator cage according to claim 4 including at least one support positioned in the cut-out for stabilizing the at least one ventilation channel.

6. The elevator cage according to claim 2 wherein the at least one ventilation channel has a curved form.

7. The elevator cage according to claim 6 wherein the at least one ventilation channel is formed as a bore.

8. The elevator cage according to claim 2 wherein the at least one ventilation channel is formed by a porous region of the insulating element.

9. The elevator cage according to claim 1 wherein the ventilating device includes a cover element, the cover element and the insulating element cooperating to form the at least one ventilation channel.

10. The elevator cage according to claim 9 wherein the cover element and the insulating element are adhesively fastened to the one outer surface.

11. The elevator cage according to claim 1 wherein insulating element is adhesively fixed to the one outer surface.

12. The elevator cage according to claim 1 wherein a cable guide is disposed on the ventilating device.

13. The elevator cage according to claim 1 including a fan positioned at the at least one primary ventilating opening.

14. The elevator cage according to claim 13 wherein the fan is configured to be switched on.

15. The elevator cage according to claim 13 wherein the fan is capable of being used with a computer.

16. An elevator installation, comprising:

an elevator cage disposed in an elevator shaft, the elevator cage having a plurality of outer surfaces delimiting a cage interior space;

a ventilating device fastened to a one of the outer surfaces, the ventilating device including at least one ventilation channel for exchange of air between the cage interior space and an exterior of the elevator cage, the at least one ventilation channel having at least one primary ventilation opening open to the elevator cage exterior, the one outer surface having at least one secondary ventilation opening between the cage interior space and the at least one ventilation channel; and an insulating element included in the ventilating device and being formed of an insulating material, the insulating element forming a horizontally extending surface of the at least one ventilation channel, the at least one primary ventilation opening and the at least one secondary ventilation opening being positioned at a same height relative to the one outer surface to guide air flow substantially horizontally through the at least one ventilation channel of the ventilating device, wherein the one outer surface is a roof of the elevator cage and the ventilating device forms a part of a foot strip on the cage roof leaving a portion of the cage roof exposed.

17. The elevator installation according to claim 16 wherein another of the outer surfaces is a floor of the elevator cage, and including another one of the ventilating device fastened to the elevator cage floor.

* * * * *